US005530556A

United States Patent [19]

Miura et al.

[11] Patent Number: 5,530,556

[45] Date of Patent: Jun. 25, 1996

[54] RECORDING APPARATUS WITH DUAL INDEPENDENT CONTROL LIMITS

[75] Inventors: Shigeo Miura; Takehiro Yoshida, both of Tokyo; Shigeru Koizumi, Urawa; Yasuo Fujii; Toru Nakayama, both of Yokohama; Junnosuke Kataoka, Kawasaki, all of Japan

[73] Assignee: Canon Kabushiki Kaisha, Tokyo, Japan

[21] Appl. No.: 192,815

[22] Filed: Feb. 7, 1994

[30] Foreign Application Priority Data

Feb. 10, 1993 [JP] Japan ..... 5-022669
Feb. 10, 1993 [JP] Japan ..... 5-022670

[51] Int. Cl.[6] ..... G03G 15/00; G03G 15/20

[52] U.S. Cl. ..... 358/300; 347/156; 355/285

[58] Field of Search ..... 355/282, 285, 355/219, 216; 358/300, 296; 347/156

[56] References Cited

U.S. PATENT DOCUMENTS 5,115,278 5/1992 Marata et al. ..... 355/285

5,210,580 5/1993 Aslam et al. ..... 355/290

*Primary Examiner*—Joseph W. Hartary
*Assistant Examiner*—Craig A. Hallacher
*Attorney, Agent, or Firm*—Fitzpatrick, Cella, Harper & Scinto

[57] ABSTRACT

A recording apparatus such as a facsimile apparatus comprises a first control unit to perform a control regarding the generation of dot data, a second control unit for controlling the recording operation, a fan to reduce a temperature in the apparatus, a heat fixing device having a heater, and detectors such as thermistors for detecting temperatures at a plurality of positions near the fixing device. Each of the first and second control units generates a first control signal to control the rotation of the fan on the basis of detection outputs from the thermistors. The heat fixing device has a cylindrical endless film made by polyimide or the like whose inner surface is come into contact with the heater and a pressure roller which is come into contact with the outside of the endless film. A recording paper is sandwiched between the film and the pressure roller and passes therebetween.

20 Claims, 11 Drawing Sheets

FIG. 1A
FIG. 1
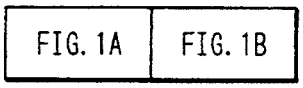
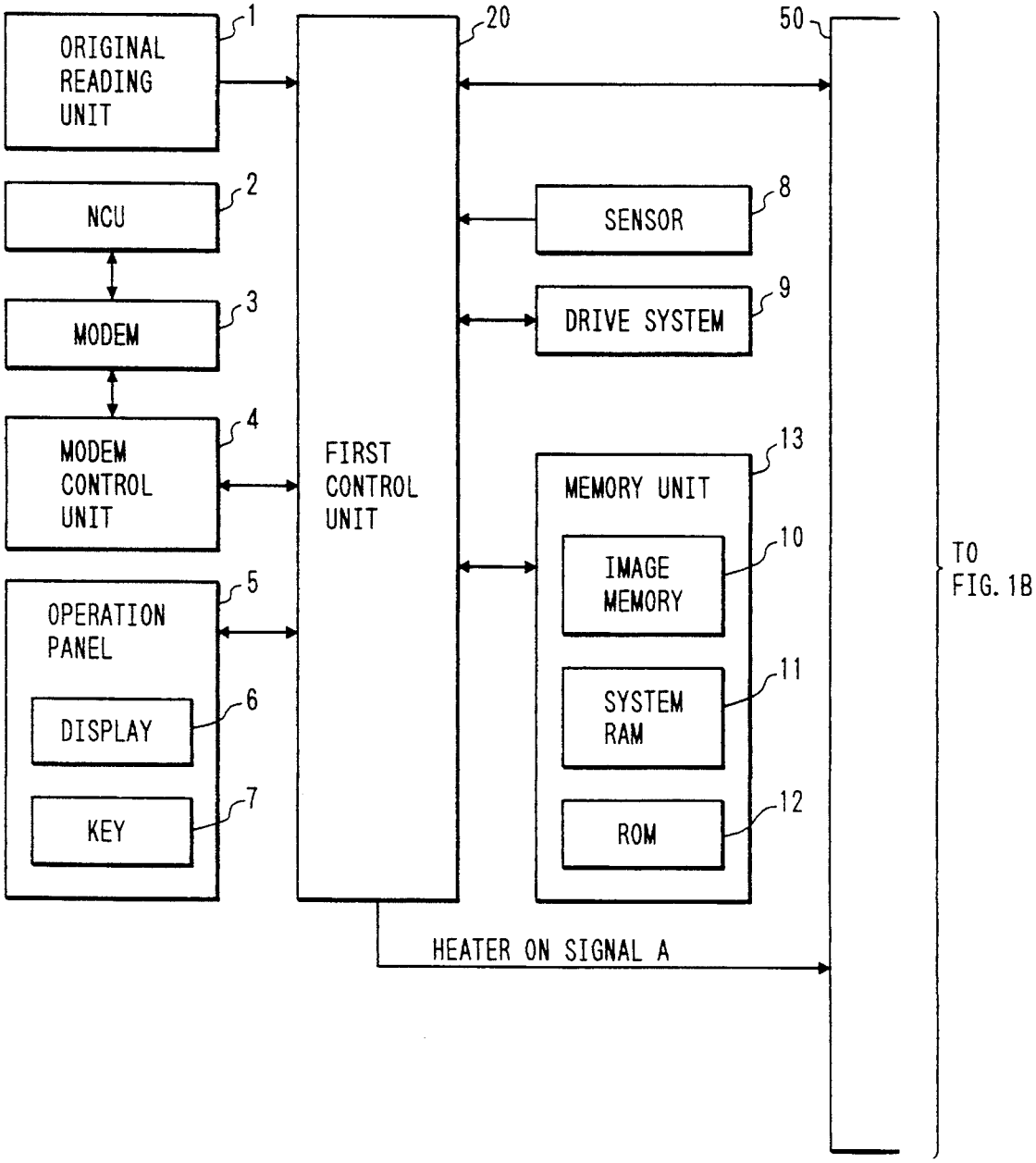

| FIG. 8A | FIG. 8B |
|---|---|

RECORDING APPARATUS WITH DUAL INDEPENDENT CONTROL LIMITS

BACKGROUND OF THE INVENTION

1. Field of the Invention

The invention relates to a recording apparatus such as a facsimile apparatus or the like and, more particularly, to a fan control of a recording apparatus having a heat fixing heater and a fan.

2. Related Background Art

Hitherto, a halogen lamp is used as a heater of a heat fixing device which is used in a recording unit or the like of a laser beam printer facsimile apparatus (hereinafter, referred to as an LBPFAX). The heater by the halogen lamp has characteristics such that a temperature of the fixing unit of the heat fixing device is gradually raised because a heat capacity of the heater itself is large. In this case, the temperature rising characteristics of the fixing unit are gentle.

When considering the case where a power source of the apparatus is turned on in a cooled state of the fixing unit, it takes a long time until the fixing unit can execute a fixing operation. Therefore, in the ordinary state, after the power source was turned on, the temperature is adjusted so as to keep the temperature of the fixing unit constant.

The temperature at the time of such a temperature adjustment is set to a very high temperature such as 180° C. or the like. When the temperature adjustment is executed, therefore, the temperature and moisture in the apparatus cause problems. In order to reduce the temperature and moisture in the apparatus, a fan is ordinarily attached to the apparatus. After the power source was turned on, by continuously rotating the fan, the temperature in the apparatus is reduced.

The control of the fan, on the other hand, is designed on the basis of the idea of the fail safe. Although a mode to change a rotational speed of the fan on the basis of an instruction from a CPU exists in the control circuit, a mode such as to stop the rotation of the fan does not exist on an electric circuit.

Therefore, even when an image is not printed in a silent office or the like, the fan is always rotated, so that the rotating sound is very noisy. There is also a drawback such that since the fan is always rotated, an electric power consumption is very large.

To prevent such drawbacks, in recent years, a heat fixing device in which temperature leading characteristics of the fixing unit were made sharp has been developed.

The heat fixing device is constructed by a pressure roller, a film, and a heater.

The film included in the heat fixing device is a cylindrical film made by polyimide or the like and has a thickness of about tens of microns. The film is come into contact with the pressure roller included in the heat fixing device through a paper in a paper passing state and is directly come into contact with the pressure roller without interposing the paper in a paper non-passing state.

On the other hand, the heater included in the heat fixing device is formed in an elongated plate shape or a rod shape. A resistance material is coated onto the surface of the heater. The heater exists in the circle of the cylindrical film and is come into contact with the film and is, consequently, come into contact with the paper or pressure roller through the film (hereinafter, such a heat fixing device is referred to as a surf fixing device).

In case of the surf fixing device, it is sufficient to heat the heater just before printing after the power source was turned on. Therefore, generally, no electric power is applied to the heater, in other words, the temperature adjustment of the heater is not performed in a waiting state. Therefore, it is proper to construct the apparatus so as to rotate the fan in accordance with the necessity when the electric power is applied to the heater, namely, when the temperature of the heater is adjusted.

In the above surf fixing device, however, the film made by polyimide or the like generally has a thickness of about tens of microns and is very thin. Therefore, when an excessive temperature increase occurs on the surface of the film, namely, in the contact portion with the heater or the contact portion with the pressure roller or recording paper, there is a serious problem such as occurrence of damage, smoke emission, or fire production of the film. Consequently, there is an anxiety.

On the other hand, it is technically impossible to detect the surface temperature of the contact portion of the film by allowing a thermistor which is generally used to come into contact with the contact portion because of the problems on durability and reliability of the thermistor, film, and pressure roller.

Therefore, since there is a danger of the occurence of damage, smoke emission, or fire production of the film, for example, a vain operation for rotating the fan is executed in spite of the fact that the temperature of the film is low.

In a recording apparatus such that the temperature is detected and the fan is rotated by a control unit such as a CPU or the like, there is a possibility such that the CPU or the like runs away and the apparatus is subjected to a very dangerous state due to an increase in temperature.

SUMMARY OF THE INVENTION

It is an object of the invention to solve the problems mentioned above.

Another object of the invention is to provide a recording apparatus which can prevent an overheat of a heat fixing device and can reduce noises for a period of time during which the printing operation is not executed.

Still another object of the invention is to improve safety in a recording apparatus using a surf fixing device.

According to the invention, there is provided a recording apparatus comprising: a heat fixing device having a heater; a fan to reduce a temperature in the apparatus; a plurality of temperature detecting means for detecting temperatures at a plurality of positions near the heat fixing device; an A/D converter for converting outputs from those plurality of temperature detecting means into digital values; and a CPU, wherein the CPU executes calculations on the basis of a plurality of digital values corresponding to the temperatures at a plurality of positions and controls the rotation of the fan.

Consequently, a temperature of a portion with which the temperature detecting means such as a thermistor or the like cannot directly come into contact is predicted and the fan can be rotated on the basis of the predicted temperature value. It is possible to prevent the occurrence of breakdown, damage, smoke emission, or fire production of such a portion having the predicted temperature value.

According to a preferred embodiment of the invention, the heat fixing device is constructed by a pressure roller, a film, and a heater. The film is a cylindrical (endless) film made by polyimide or the like and is come into contact with the pressure roller through a paper in a passing paper state and is directly come into contact with the pressure roller in a non-passing paper state. The heater exists in the circle of the cylindrical film and is come into contact with the film and is, consequently, come into contact with the paper or pressure roller through the film (surf fixing device). In this case, the CPU predicts a temperature of the contact portion between the film and the pressure roller or paper or the contact portion between the film and the heater. Consequently, in particular, safety of the film of the surf fixing device having a fear of occurrence of breakdown, damage, smoke emission, or fire production can be assured.

According to another embodiment of the invention, at least one or more of the above plurality of temperature detecting means (thermistors) is come into contact with the heater or the pressure roller.

Therefore, when judging whether the fan should be rotated in order to assure the safety of the film of the surf fixing device having a fear of occurrence of breakdown, damage, smoke emission, or fire production or not, a precision of the prediction temperature can be raised. Thus, the fan can be certainly rotated in order to raise the safety of the film of the surf fixing device.

According to still another embodiment of the invention, the CPU uses the temperature values, as parameters, which were detected by the plurality of temperature detecting means such as thermistors or the like attached to the heater, pressure roller, and the like and predicts surface temperatures of the contact portions on the heater side of the film and on the pressure roller side. The CPU controls the rotation or the like of the fan on the basis of the predicted surface temperature values, thereby further reducing a danger of the occurrence of breakdown, damage, smoke emission, or fire production of the film.

Generally, the surface temperature on the heater side of the film is high. However, a grease is ordinarily coated to the heater side surface of the film made by polyimide or the like, namely, on the inside surface of the cylindrical film. Therefore, the durability for the temperature or the like on the heater side differs from that on the pressure roller side.

Therefore, by predicting the surface temperatures of both of the contact portions, the safety of each contact portion can be assured.

The surface temperatures on the heater side and the pressure roller side of the film are predicted with respect to both of the portion in which the recording paper passes (hereinafter, referred to as a passing paper portion) and the portion in which no recording paper passes (hereinafter, referred to as a non-passing paper portion). On the basis of the predicted surface temperature values, the rotation or the like of the fan motor is controlled, thereby further reducing a danger of the occurrence of breakdown, damage, smoke emission, or fire production of the film.

Since the temperature of the passing paper portion and the temperature of the non-passing paper portion differ, there is a case where the fan motor is individually controlled. The safety can be improved at any position.

According to the invention, further, there is also provided a recording apparatus comprising: a first control unit for performing a control regarding the generation of dot data; a second control unit for controlling a recording operation; a fan to reduce a temperature in the apparatus; a heat fixing device having a heater; and means for detecting a temperature near the heat fixing device, wherein each of the first and second control units generates a first control signal for controlling the fan on the basis of an output from the temperature detecting means.

For example, a facsimile apparatus having a recording unit of the electrostatic recording system such as a laser beam printer (hereinafter, referred to as an LBP) or the like (hereinafter, such a facsimile apparatus is referred to as an LBP-FAX) has a recording system control unit (second control unit) and a control unit (first control unit) of a communication or the like other than the recording system.

According to the invention, since the rotation of the fan is controlled by not only the first control unit but also the second control unit, even when either one of the control units enters an abnormal state, the fan can be rotated by the other control unit, so that a danger due to the temperature increase can be prevented.

According to a preferred embodiment of the invention, the heat fixing device is constructed by the pressure roller, film, and heater. The film is a cylindrical (endless) film made by polyimide or the like and is come into contact with the pressure roller through a paper in a paper passing state and is directly come into contact with the pressure roller without interposing the paper in a non-passing paper state. The heater exists in the circle of the cylindrical film and is come into contact with the film and is, consequently, come into contact with the paper or pressure roller through the film (surf fixing device). The first and second control units use the temperatures, as parameters to be predicted, of the contact portion between the film and the pressure roller or paper and the contact portion between the film and the heater, so that it is possible to assure the safety of the film of the surf fixing device having a fear of the occurrence of, particularly, breakdown, damage, smoke emission, and fire production.

According to further another embodiment, the apparatus has means for generating a detection signal (hereinafter, referred to as a fan lock signal) indicating whether the fan is normally rotating or not, and the first and second control units independently execute an abnormality treatment such that the apply of an electric power to the heater is stopped or the like on the basis of the detection signal, respectively.

A control such that the electric power is applied to the heater or the like which results in an increase in temperature or moisture of the apparatus is executed by a plurality of control units while confirming the rotation of the fan. Due to this, even if one of the control units does not normally operate due to a run-away of the CPU or the like, an abnormality of the fan is detected by another control unit and the control which results in an increase in temperature or moisture of the apparatus is stopped, thereby further assuring the safety of the apparatus.

The above and other objects and features of the present invention will become apparent from the following detailed description and the appended claims with reference to the accompanying drawings.

DESCRIPTION OF THE PREFERRED EMBODIMENTS

Preferred embodiments of the present invention will now be described hereinbelow with reference to the drawings.

[First embodiment ]

FIGS. 1A to 7 relate to a facsimile apparatus according to the first embodiment of the invention.

Figure 1B:
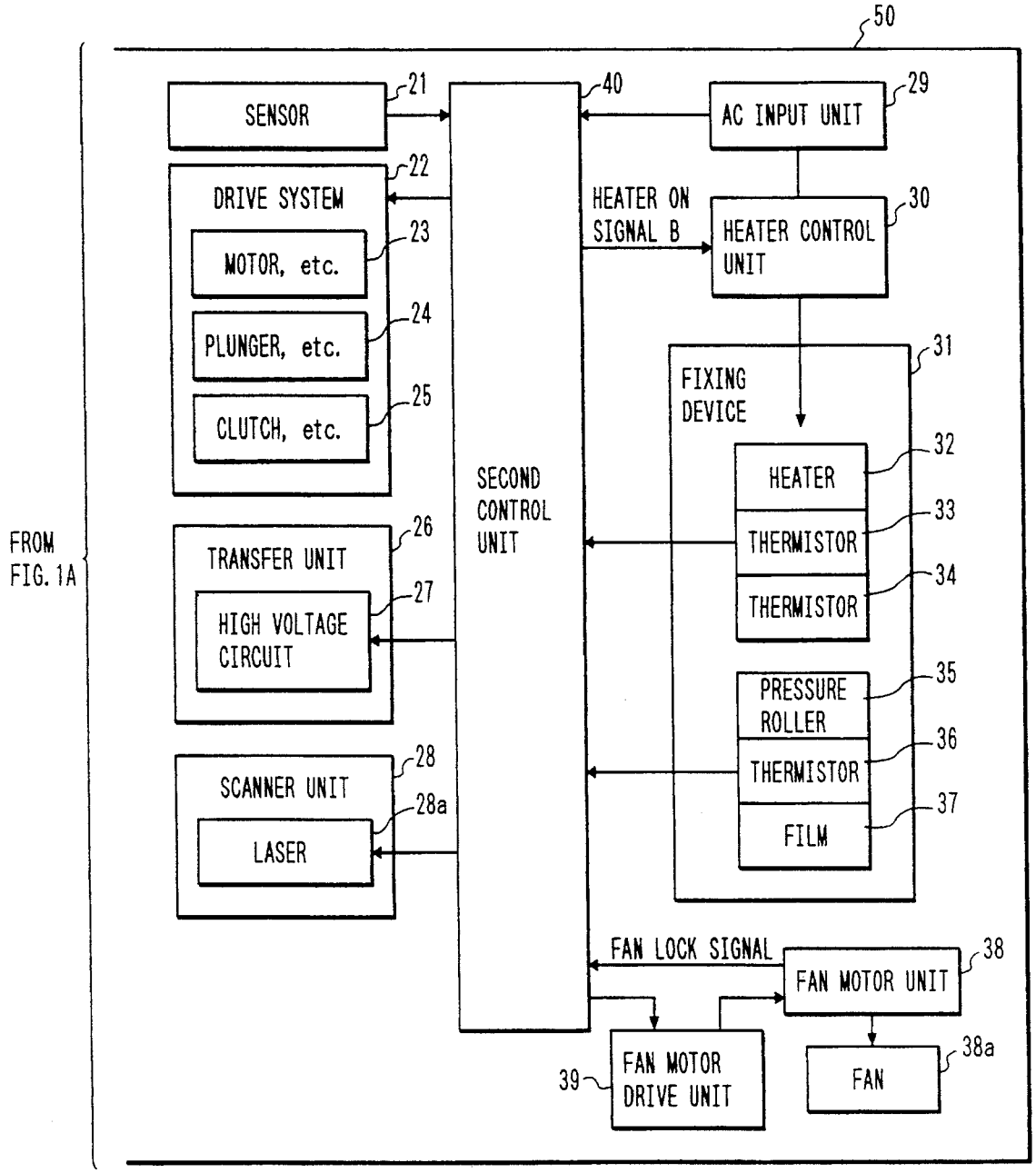
FIG. 1 is comprised of FIG. 1A and FIG. 1B showing block constructional diagrams of a facsimile apparatus of the first embodiment of the present invention.

FIGS. 1A and 1B are block constructional diagrams of the first embodiment.

In the diagram, reference numeral 1 denotes an original reading unit for reading an image of a transmission original and converting into image data; 2 a network control unit (NCU) for connecting a telephone line to a facsimile; 3 a modulating and demodulating apparatus (namely, modem) for performing a communication; 4 a modem control unit to control the modem 3; 5 an operation panel; 6 a display which is included in the operation panel 5 and displays a state of the facsimile apparatus to the user; 7 keys which are included in the operation panel 5 and are used for the user to instruct various kinds of operations to the facsimile; 8 a sensor to detect a state of the facsimile; 9 a drive system which is constructed by a reading motor or the like for conveying the original; 10 an image memory for storing reception image or the like; 11 a system RAM (or system memory) which is backed up by a battery or the like and no data is erased even when a commercially available power source is shut off as in case of a power failure or the like; 12 an ROM to decide the specification of the facsimile; 13 a memory unit including the image memory 10, system RAM 11, and ROM 12; and 20 a first control unit to control the above construction.

The control unit 20 stores the dot data which was read by the original reading unit or the dot data which is obtained by expanding the coded compression data received through the communication line into the image memory 10 by an amount of one page and supplies to a recording unit 50.

A construction of the recording unit 50 will now be described.

Reference numeral 21 denotes a sensor for detecting various kinds of states of the recording unit by a laser beam printer or the like. Reference numeral 22 denotes a drive system for performing the conveyance of a recording paper or the like. The drive system 22 has: a motor 23 and the like for performing the conveyance of the recording paper or the like; a plunger 24 and the like for deciding and controlling a driving section which is driven by the motor 23 and the like; and a clutch 25 and the like for turning on/off the transfer of the driving force for controlling the driving section in a manner similar to the plunger 24 and the like. Reference numeral 26 denotes a transfer unit for transferring an image formed on a photosensitive material onto the recording paper; 27 a high voltage circuit for producing a high voltage which is necessary for such a copy transfer; 28 a scanner unit to scan a laser beam; **28*a* a laser for generating a laser beam; 29 an AC input unit for inputting an AC voltage which is applied to a heater; 30 a heater control unit which is constructed by a triac or the like and controls the AC voltage which is applied to the heater; and 31 a heat fixing device for thermally fixing the image on the paper. The fixing device 31 has: a heater 32 for applying the heat to the recording paper, thereby fixing the image on the paper; a thermistor 33 which is attached to the heater 32 and detects a temperature of a passing paper portion of the recording paper; a thermistor 34 to detect a temperature of a non-passing paper portion of the recording paper; a pressure roller 35 for applying a pressure to the recording paper; a thermistor 36 to detect a temperature of the pressure roller 35; and a film 37 for separating the heater 32 so as to be away from the recording paper or the pressure roller 35. Reference numeral 38 denotes a fan motor unit for rotating a fan 38*a* to reduce the temperature in the apparatus; 39 a fan motor drive unit for driving the fan motor unit 38; and 40 a second control unit to control the whole recording unit 50**.

Figure 2:
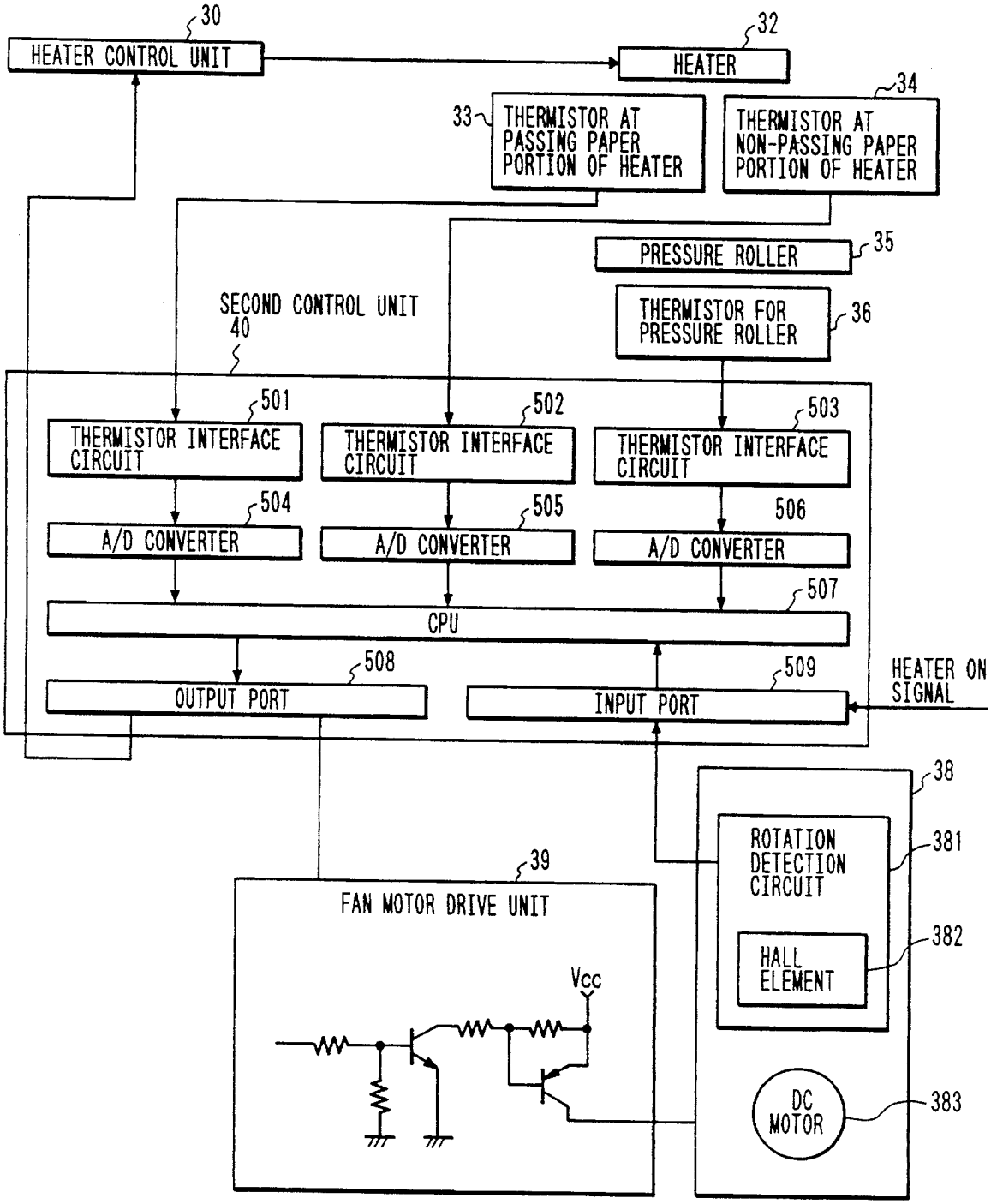
FIG. 2 is an explanatory diagram of a block regarding a fan motor of the facsimile apparatus of the first embodiment and its control and a block regarding the temperature detection.

FIG. 2 is a block diagram of a construction regarding the control of the facsimile apparatus and the detection of the temperature according to the invention.

Reference numerals 501 to 503 denote thermistor interface circuits for converting resistance values of the thermistors 33, 34 and 36 whose resistance values are changed in dependence on the temperature into analog voltage values, respectively.

Reference numeral 504 denotes an A/D converter for converting the analog signal of the heater passing paper portion (on the heater side) which had been detected by the thermistor 33 and was converted by the thermistor interface circuit 501 into the digital signal.

Reference numeral 505 denotes an A/D converter for converting the analog signal of the heater non-passing paper portion (on the heater side) which had been detected by the thermistor 34 and was converted by the thermistor interface circuit 502 into the digital signal.

Reference numeral 506 denotes an A/D onverter for converting the analog signal of the heater passing paper portion (on the pressure roller side) which had been detected by the thermistor 36 and was converted by the thermistor interface circuit 503 into the digital signal.

Reference numeral 507 denotes a central processing unit (CPU) for controlling the recording unit 50.

Reference numeral 509 denotes an input port for inputting signals to inform various kinds of states to the CPU 507 and 508 indicates an output port for outputting signals to execute various kinds of controls by instructions from the CPU 507.

Reference numeral 381 denotes a rotation detection circuit which is included in a fan motor unit 38 and is used to detect whether the rotation of a fan motor (DC motor in the embodiment) 383 is normally executed or not. The rotation detection circuit 381 includes a hall element 382 and the like.

Figure 3A:
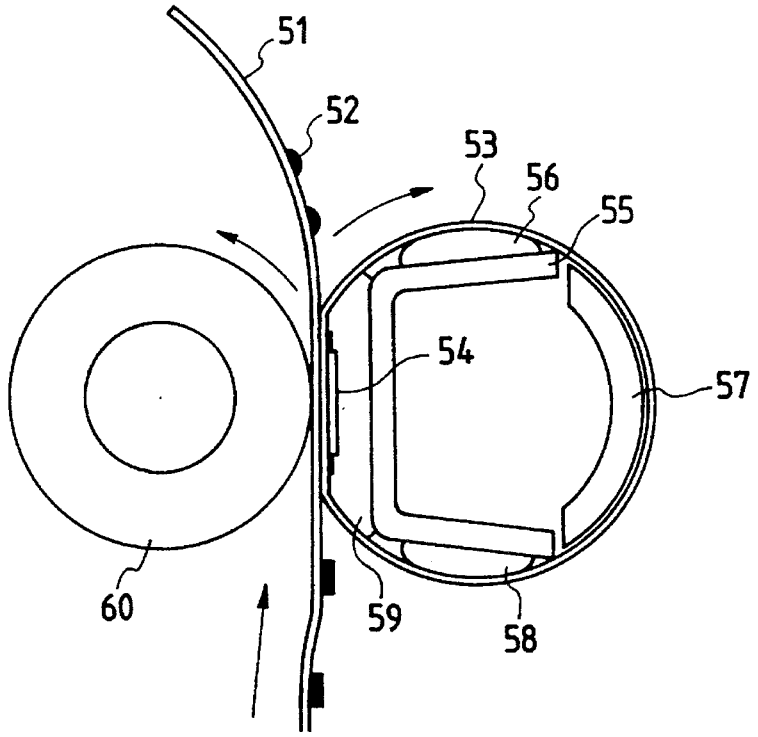
FIG. 3A is a cross sectional view of a surf fixing device provided in a recording unit of the facsimile apparatus of the invention.

FIG. 3A is a cross sectional view of the surf fixing device provided in the recording unit of the facsimile apparatus of the embodiment. In the diagram, reference numeral 51 denotes a recording paper; 52 a toner; and 53 a film which is made by polyimide or the like and in which a grease or the like is coated on the inside surface and whose surface has been treated. The film 53 corresponds to the film 37 in FIGS. 1A to 2. Reference numeral 54 denotes a heater (corresponding to the heater 32 in FIGS. 1A to 2); 55 a stay; 56, 57, and 58 film inside guides; 59 a heater holding member; and 60 a pressure roller (corresponding to the pressure roller 35 in FIGS. 1A to 2).

Figure 3B:
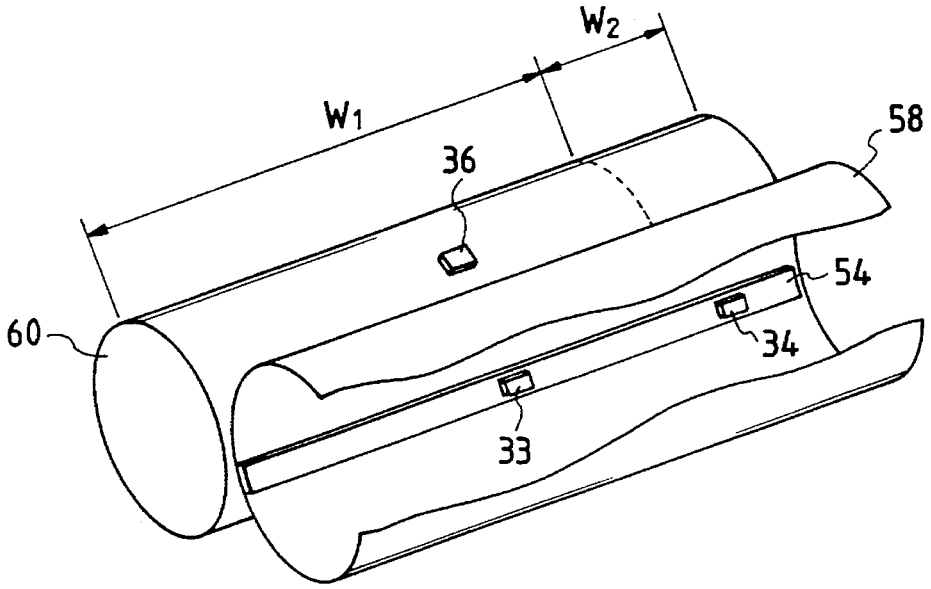
FIG. 3B is a perspective view of portions near the fixing device in the embodiment.

FIG. 3B is a perspective view showing a construction of portions near the pressure roller 60 and film 58. Constructions of a part of the film 58 and a part of the portion in the film 58 are omitted in FIG. 3B for easy understanding. The heater 54 is formed by patterning a heat generation resistor material onto one of the surfaces of a predetermined base plate. The surface of the heat generation resistor material is come into contact with the film 58 and the thermistors 33 and 34 are provided on the other surface. In the apparatus of the embodiment, in case of using a recording paper having a width (for example $w_1$) which is equal to or less than the maximum width ($w_1+w_2$) of the recording paper, the thermistor 33 is disposed at the position at which the recording paper is allowed to pass and the thermistor 34 is disposed at the position at which the recording paper is not allowed to pass.

The thermistor 36 is fixed to a member (not shown) on the downstream side in the rotating direction of the pressure roller 60 in a state in which the thermistor 36 is in contact with the pressure roller directly or through, for example, a predetermined member.

In the embodiment, temperatures of the inner and outer surfaces at the passing paper position and the non-passing paper position of the film 58 are presumed on the basis of outputs from the thermistors 33, 34 and 36.

Figure 4:
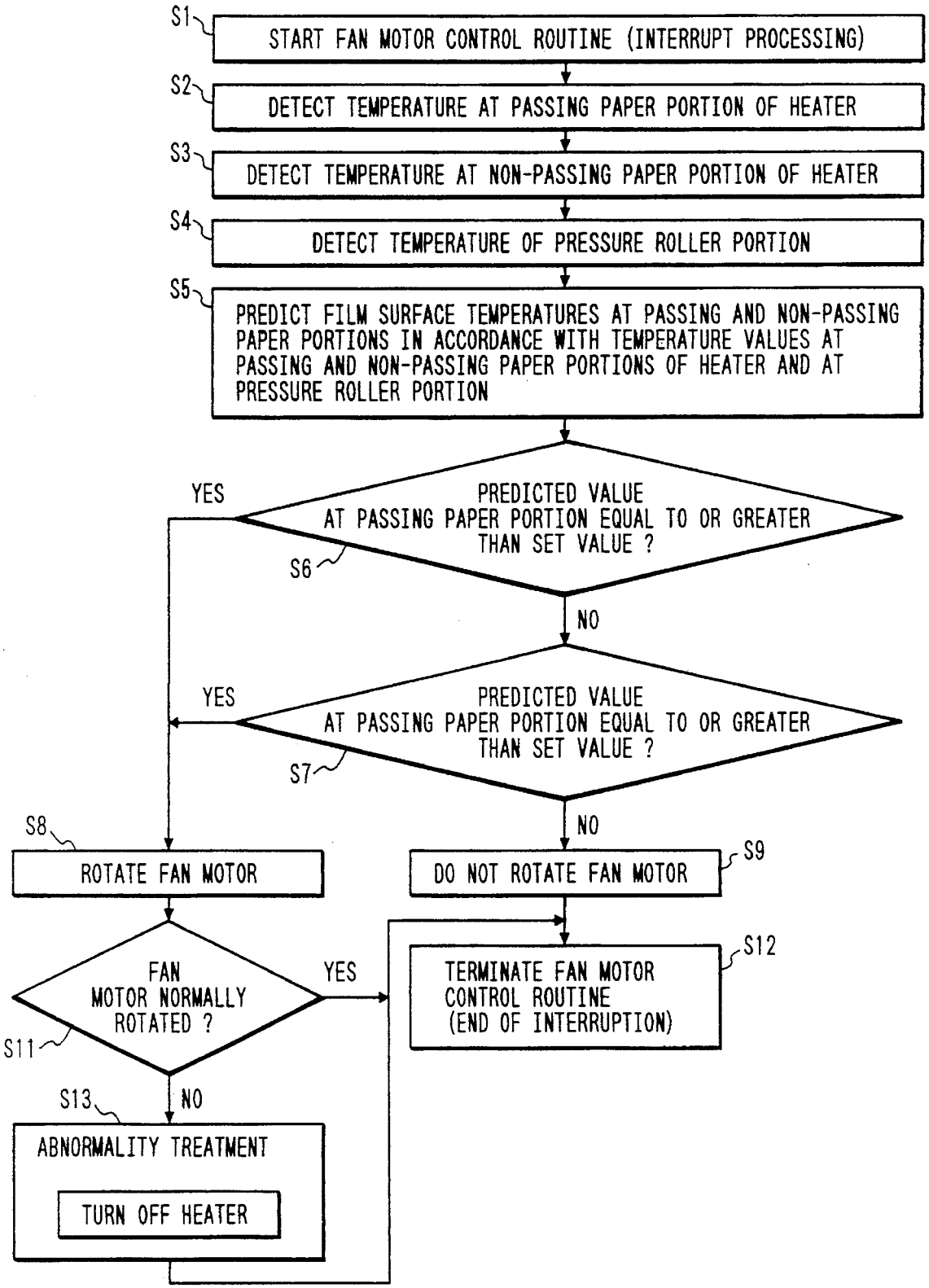
FIG. 4 is a flowchart regarding a fan control of a recording apparatus of the first embodiment.
Figure 5:
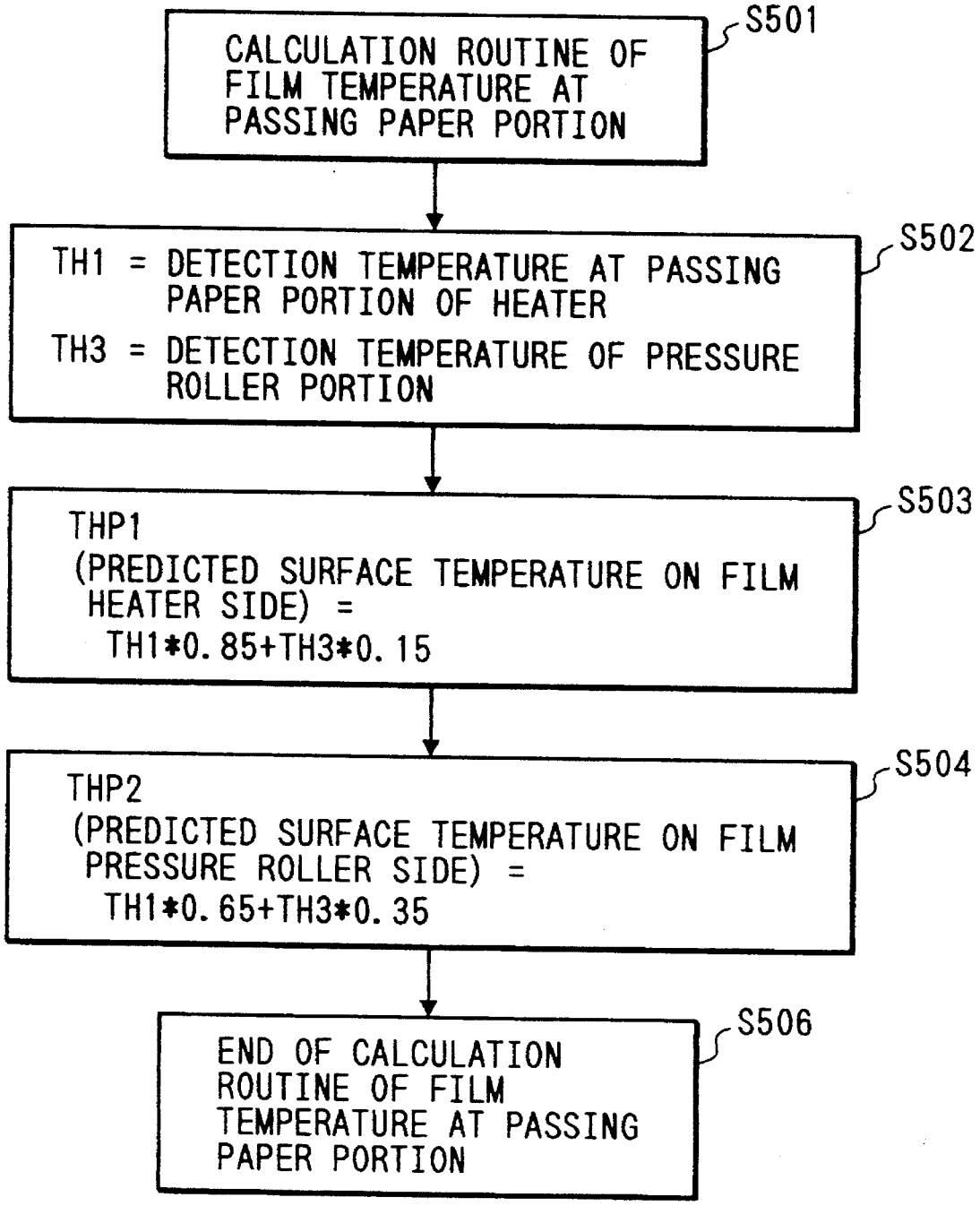
FIG. 5 is a flowchart showing a film temperature calculating routine of a passing paper portion in step S5 in FIG. 4.
Figure 6:
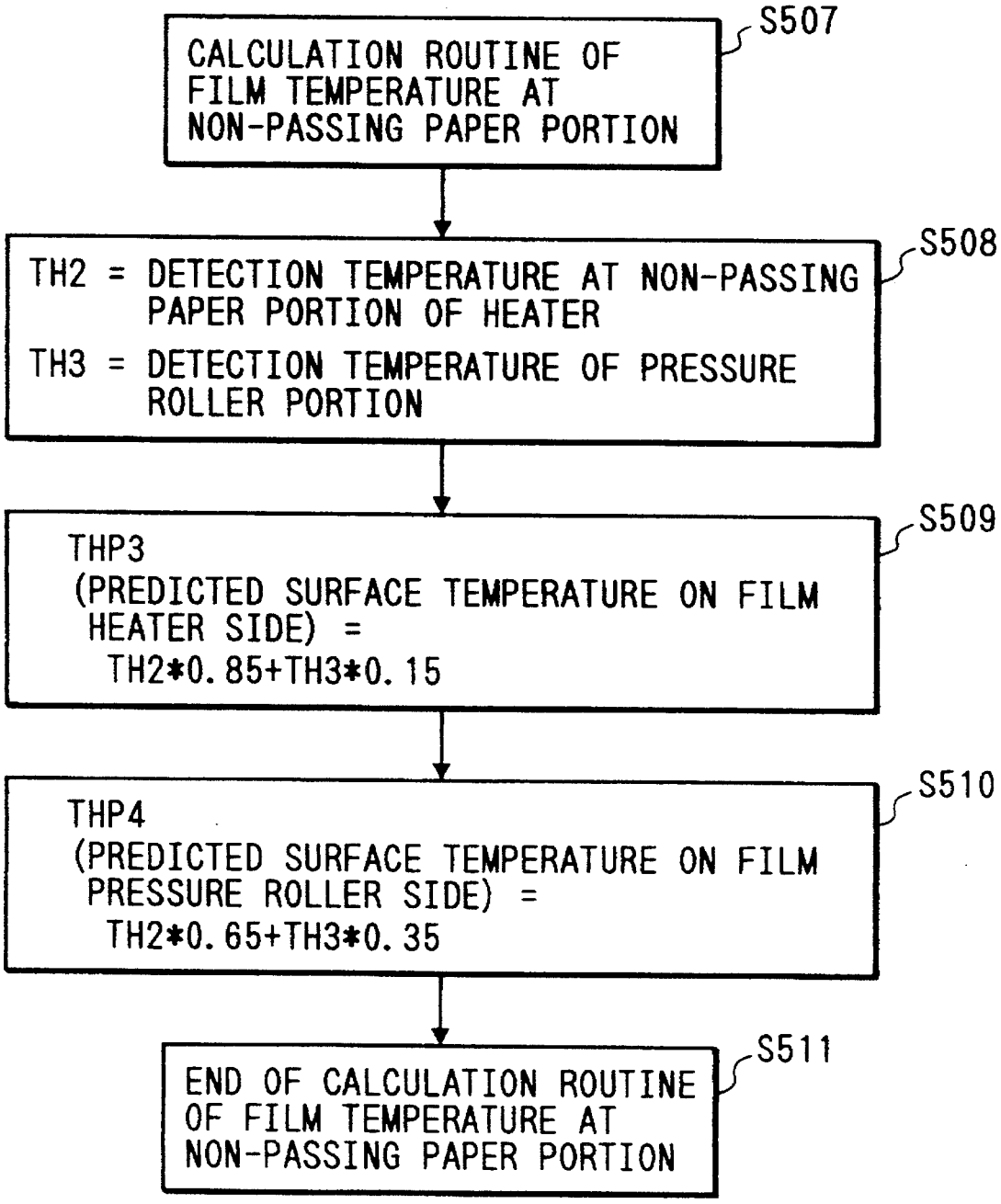
FIG. 6 is a flowchart showing a film temperature calculating routine of the passing paper portion in step S5 in FIG. 4.
Figure 7:
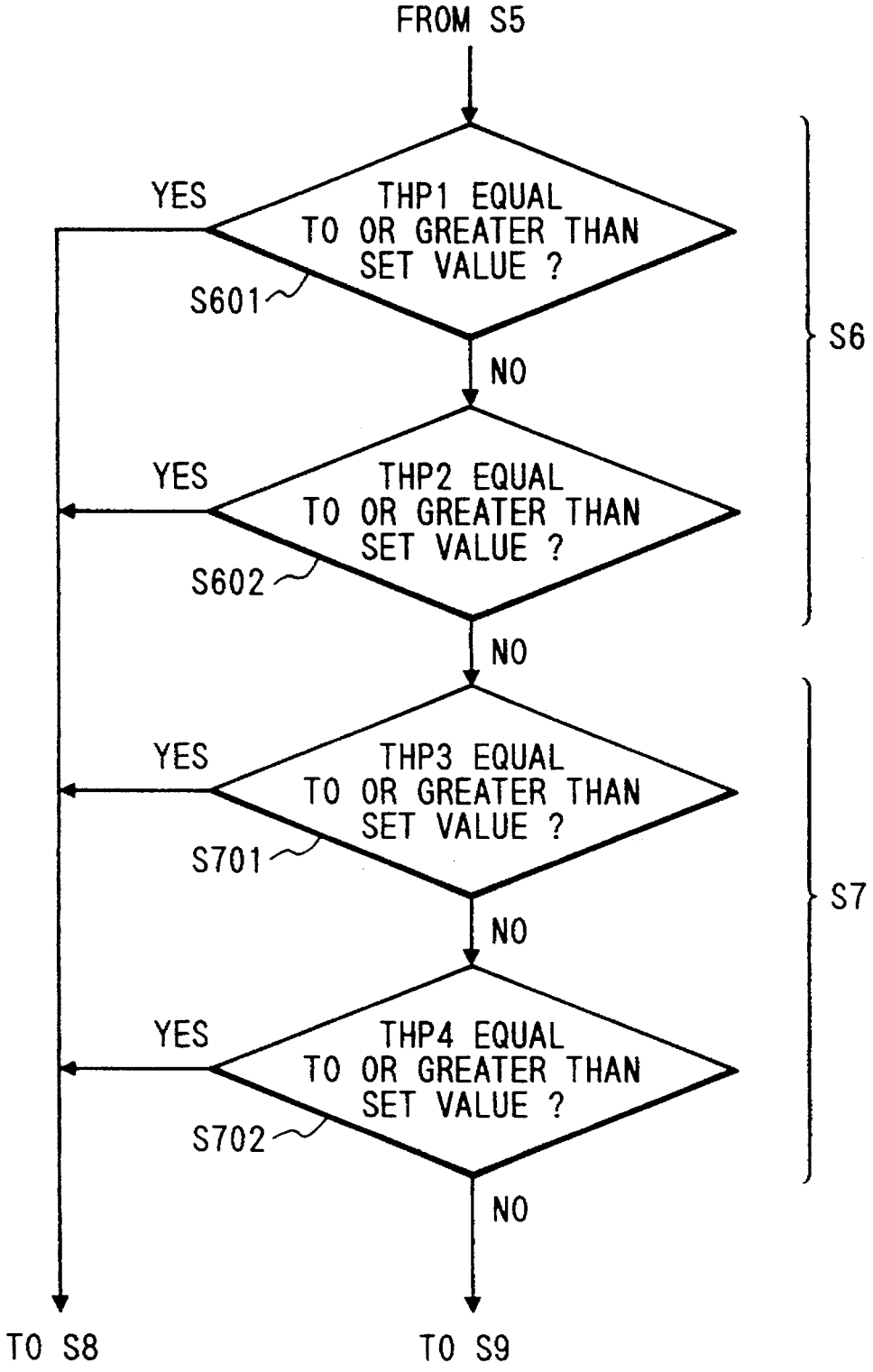
FIG. 7 is a flowchart showing steps S6 and S7 in FIG. 4.

FIG. 4 is a flowchart for a fan motor control routine of the CPU 507.

The fan motor control routine is made operative as an interruption processing every predetermined time. When an interruption occurs (S1), the temperatures of the heater passing paper portion, heater non-passing paper portion, and pressure roller portion are detected by the thermistors 33, 34 and 36 and are converted into the digital values by the A/D converters 504 to 506 and stored (steps S2 to S4). In step S5, the film surface temperatures in the passing paper portion and non-passing paper portion are presumed.

With respect to the film surface temperature in the passing paper portion (step S501 in FIG. 5), when it is now assumed that the temperature detected by the thermistor 33 is set to $TH_1$ and the temperature detected by the thermistor 36 is set to $TH_3$ (S502), a surface temperature $THP_1$ on the heater side of the film 58 in the passing paper portion and a surface temperature $THP_2$ on the pressure roller side of the film 58 are presumed by arithmetic operational equations shown in steps S503 and S504 and this routine is finished (S506).

With regard to the surface temperature in the non-passing paper portion (step S507 in FIG. 6), when it is now assumed that the temperature detected by the thermistor 34 is set to $TH_2$ and the temperature detected by the thermistor 36 is set to $TH_3$ (S508), a surface temperature $THP_3$ on the heater side of the film 58 in the non-passing paper portion and a surface temperature $THP_4$ on the pressure roller side of the film 58 are presumed by arithmetic operational equations shown in steps S509 and S510 and this routine is finished (S511).

The processes in steps S6 and S7 in FIG. 4 comprises: steps S601 and S602 for judging whether the values of $THP_1$ and $THP_2$ are equal to or larger than predetermined set values or not; and steps S701 and S702 for judging whether the values of $THP_3$ and $THP_4$ are equal to or larger than predetermined set values or not. The above set values ordinarily differ in dependence on the surface of the film.

When either one of the values of $THP_1$ to $THP_4$ is equal to or larger than the set value, the fan motor is rotated in step S8. After that, when it is determined on the basis of a fan lock signal that the fan motor is not normally rotating (S11), an abnormality treatment such as a turn-off or the heater or the like is executed (S13) and the processing routine is finished (S12).

In steps S6 and S7, when all of the values of $THP_1$ to $THP_4$ are smaller than the set values, the fan motor is not rotated (S9) and the processing routine is finished (S12).

According to the embodiment as mentioned above, calculations are executed by using the temperature values detected by the heater passing paper portion thermistor 33, heater non-passing paper portion thermistor 34, and pressure roller thermistor 36. The temperatures on the heater 32 side of the film or on the side of the pressure roller 35 or recording paper in the passing paper portion and the non-passing paper portion are presumed. When the presumed values are equal to or larger than the set values, the fan is rotated.

Although not described above, the control to adjust the temperature of the heater 32 is executed by the second control unit 40 of the recording unit 50. That is, during the adjustment of the heater temperature, a heater ON signal (or print signal (not shown)) from the first control unit 20 is always in the ON state. (When the signal A is ON, the temperature control is executed. ) On the other hand, by repeatedly turning on/off a heater ON signal B from the second control unit 40, the temperature is adjusted to a target temperature. The temperature control can be executed by adjusting the temperature of the thermistor 33 of the passing paper portion to a predetermined temperature or by adjusting the temperature $THP_2$ of the film surface on the pressure roller side of the passing paper portion to a predetermined temperature. In the embodiment, the phase of the current supply to the heater is controlled in accordance with the current temperature and the temperature change amount.

According to the invention, as mentioned above, there is provided the recording apparatus comprising: the heat fixing device which is constructed by the heater and the like; the fan motor to reduce the temperature in the apparatus; the thermistors which are attached to a plurality of portions of the heat fixing device and detect the temperatures of the plurality of portions; the A/D converter for detecting a plurality of voltage values which are changed by resistance values of the plurality of thermistors; and the CPU, wherein the CPU executes calculations on the basis of the detected temperatures of the plurality of portions and rotates the fan motor on the basis of the results of the calculations.

Due to this, the temperature of the portion with which the thermistor cannot be directly come into contact is presumed and the fan motor is rotated on the basis of the presumed temperature value, thereby preventing the occurrence of a breakdown, a damage, a smoke emission, and a fire production of such a portion of the presumed temperature value.

In the above recording apparatus, the recording unit for the purpose of printing has a heat fixing device comprising the pressure roller, film, and heater and is a recording unit of a laser beam printer, a copying apparatus, or the like having the fixing device (surf fixing device) which is constructed in a manner such that the film included in the fixing device is a cylindrical film made by polyimide or the like and is come into contact with the pressure roller included in the fixing device through the paper in the passing paper mode or is directly come into contact with the pressure roller without interposing the paper in the non-passing paper portion and that the heater included in the fixing device exists in the cylindrical circle of the film and is come into contact with the film and is come into contact with the paper or pressure roller through the film. The results of the calculations are used as parameters for presuming the temperature in the contact portion between the film and the pressure roller or paper or in the contact portion between the film and the heater. With the above construction, the above invention is effectively applied to the surf fixing device. Due to this, in particular, the safety of the film of the surf fixing device having a fear such as occurrence of a breakdown, a damage, a smoke emission, or a fire production is assured.

In the above recording apparatus or facsimile apparatus, at least one of a plurality of thermistors is connected to the heater or pressure roller.

Consequently, a precision when presuming the temperature of the relevant portion of the temperature to be presumed in order to judge whether the rotation of the fan motor is executed or not for the purpose of assuring the safety of the film of the surf fixing device having a fear of occurrence of a breakdown, a damage, a smoke emission, or a fire production is raised. Thus, the rotation of the fan motor to raise the safety of the film of the surf fixing device is smoothly executed.

In the recording apparatus or facsimile apparatus having the surf fixing device mentioned above, the temperature values detected by the temperature detecting elements of a plurality of thermistors or the like attached to the heater, the pressure roller, and the like are used as parameters. The surface temperatures of the contact portion on the heater side of the film and on the pressure roller side are presumed. On the basis of the presumed surface temperature values, the operation and control of the apparatus such as rotation of the fan motor and the like are changed, thereby further reducing the danger of the occurrence of a breakdown, a damage, a smoke emission, or a fire production of the film.

Ordinarily, the surface temperature of the film on the heater side is high. A grease or the like is generally coated on the surface of the heater side of the film made by polyimide or the like, namely, on the inside surface of the cylindrical film. Namely, the durability due to the temperature or the like of the contact portion on the heater side differs from that on the pressure roller side.

Therefore, by presuming the surface temperatures of both of the contact portions, different safety are assured.

In the above recording apparatus, the surface temperatures on the heater side of the film and the pressure roller side are presumed with respect to both of the passing paper portion in which the recording paper passes and the non-passing paper portion in which the recording paper does not pass. On the basis of the presumed surface temperature values, the operation and control of the apparatus such as rotation of the fan motor or the like are changed, thereby further reducing the danger of the occurrence of a breakdown, a damage, a smoke emission, or a fire production of the film.

Ordinarily, since the temperature of the passing paper portion differs from that of the non-passing paper portion, the temperature of both of them are presumed and used in consideration of the improvement of the safety.

[Second embodiment ]

Figures 8, 8A:
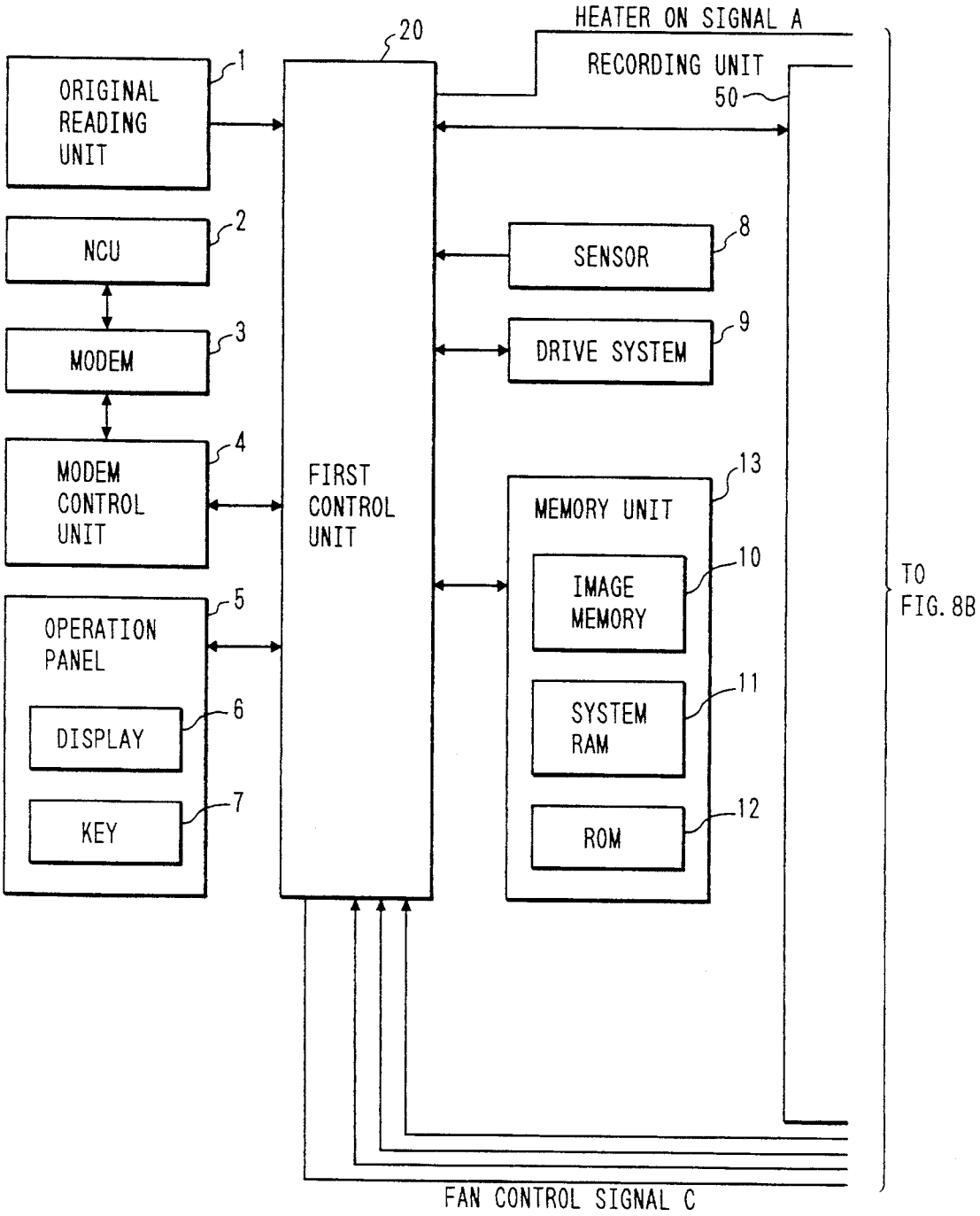
FIG. 8 is comprised of FIG. 8A and FIG. 8B showing block constructional diagrams of a facsimile apparatus in the second embodiment of the present invention.
Figure 9:
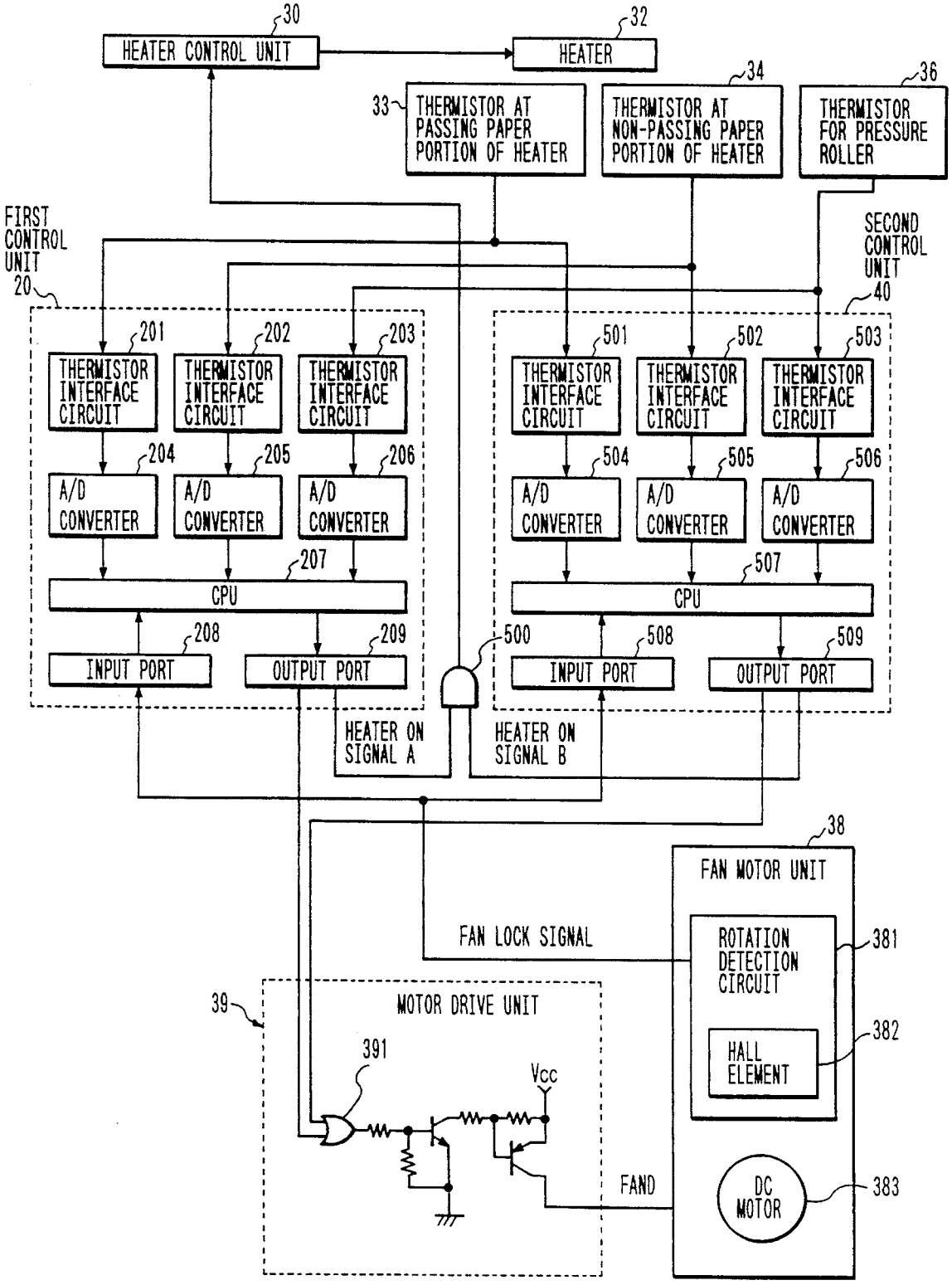
FIG. 9 is an explanatory diagram of a block regarding a fan motor of the facsimile apparatus and its control and a block regarding the temperature detection in the second embodiment.

FIGS. 8A to 9 are explanatory diagrams of a facsimile apparatus of the second embodiment of the invention.

Figure 8B:
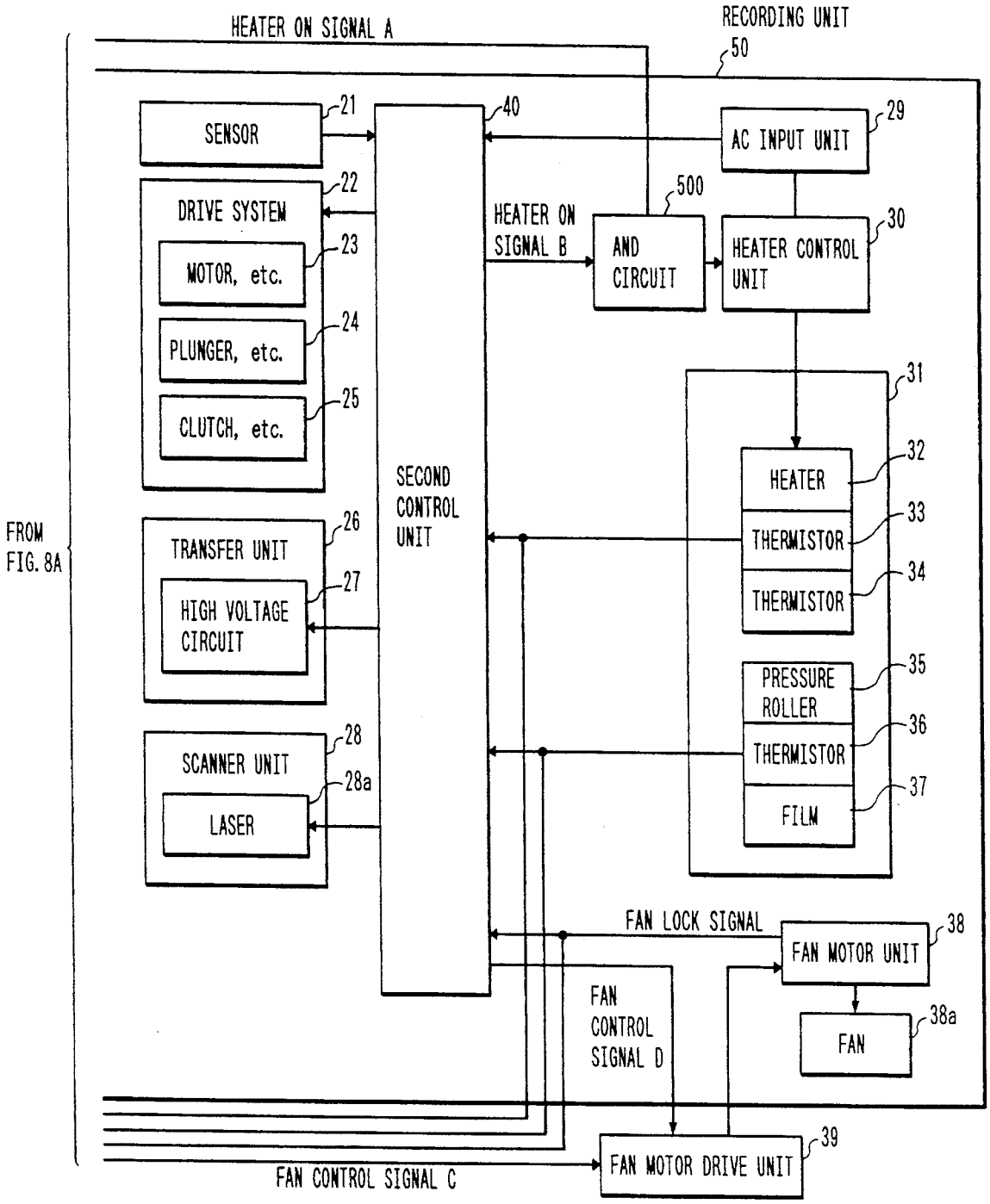

FIGS. 8A and 8B are block constructional diagrams of the facsimile apparatus of the embodiment.

The second embodiment differs from the above first embodiment with respect to the following points. Namely, first, there is provided an AND circuit 500 for calculating the AND of the heater ON signal A from the first control unit 20 and the heater 0N signal B from the second control unit 40 and for outputting the result to the heater control unit 30. Second, the outputs from the thermistors 33, 34 and 36 and the fan lock signal are given not only to the second control unit 40 but also to the first control unit 20. Third, the signal to control the fan motor which is supplied from the first control unit 20 is output to the fan motor drive unit 39.

In the embodiment, in not only the second control unit 40, but also in the first control unit, the heater and the fan motor are controlled on the basis of the outputs from the thermistors 33, 34 and 36. With respect to such a control, the fan motor drive unit 39 also differs from that in the first embodiment as will be explained hereinlater.

FIG. 9 is a block diagram showing a construction regarding the control of the fan motor and the temperature detection in the embodiment.

The construction of FIG. 9 differs from that of the foregoing first embodiment (FIG. 2) with respect to a point that the first control unit 20 has thermistor interface circuits 201 to 203, A/D converters 204 to 206, a CPU 207, an input port 208, and an output port 209 in a manner similar to the second control unit 40. In the embodiment, the OR is calculated between the fan control signal which is output from the output port 209 and the fan control signal from the second control unit 40 by an OR circuit 391 provided in the motor drive unit 39.

In the embodiment, the CPU 209 of the first control unit 20 also executes the processes shown in FIG. 4 of the first embodiment. In the embodiment, therefore, when the first and second control units 20 and 40 normally operate, the heater ON signals A and B are output as almost same signals although there is a slight difference between the timings. The fan control signals C and D are also almost the same signals.

That is, each of the first and second control units 30 and 40 independently detects an increase in temperature of the heater and rotates the fan motor when the detected heater temperature or the like is equal to or larger than a predetermined value. The fan motor is independently rotated by detecting the fan lock signal. When the fan has been locked, an abnormality treatment such that the heater is forcedly turned off or the like is independently executed. Due to this, the safety of the apparatus is improved.

The control to adjust the temperature of the heater is executed by the control unit 40 in a manner similar to the first embodiment.

There is provided a facsimile apparatus comprising a first control unit to perform a control of the communication, reading of an original image, or the like, a second control unit to control the recording operation such as an image printing or the like, and a fan motor for reducing a temperature in the apparatus, wherein a recording unit to record has a heat fixing device which is constructed by a heater and the like and means for detecting a temperature of the heat fixing device, the temperature of the fixing device is controlled by the second control unit on the basis of the temperature of the fixing device detected by the detecting means, the heat fixing device temperature detecting means exists in each of the first and second control units, and when the temperature of the fixing device is equal to or larger than a set value, each of the first and second control units generates a control signal to rotate the fan motor, and the fan motor is rotated when the control signal is generated from either one of the first and second control units.

In a recording apparatus in which the temperature is detected and the fan motor is rotated by the control unit such as a CPU or the like, there is a possibility such that the CPU or the like runs away and the apparatus enters a very dangerous state due to an increase in temperature.

A facsimile apparatus ( hereinafter, referred to as an LBP-FAX) having a laser beam printer (hereinafter, referred to as an LBP) as a recording unit has a plurality of control units such as recording system control unit and control unit for performing the communication and the like other than the recording.

According to the facsimile of the invention, the fan motor is also rotated even by the control unit other than the recording system control unit. Therefore, even in the case where the recording system control unit enters an abnormal state, the fan motor is rotated by another control unit, thereby preventing that the apparatus enters a dangerous state by the increase in temperature.

In the above facsimile apparatus, the recording unit for the purpose of printing has a heat fixing device which is constructed by the pressure roller, film, and heater, and the recording unit is a recording unit of a laser beam printer, a copying apparatus, or the like having a fixing device (hereinafter, referred to as surf fixing device) which is constructed in a manner such that the film included in the heat fixing device is a cylindrical film made by polyimide or the like and is come into contact with the pressure roller included in the fixing device through the paper in the passing paper state and is directly come into contact with the pressure roller without interposing the paper in the non-passing paper state and the heater included in the fixing device exists in the circle of the cylindrical film and is come into contact with the film and is come into contact with the paper or pressure roller through the film, and the results of the above calculations are used as parameters for predicting the temperature of the contact portion between the film and the pressure roller or paper or the contact portion between the film and the heater, so that the inventions mentioned above are effectively applied to the surf fixing device. Consequently, the safety of the film in the surf fixing device having a fear of occurrence of a breakdown, a damage, a smoke emission, or a fire production is assured.

The above facsimile apparatus is constructed in a manner such that the apparatus has the fan motor for generating the detection signal (hereinafter, referred to as a fan lock signal) indicating whether the fan motor is normally rotating or not, the fan lock signal is detected by each of the first and second control units, and when the detection signal is detected by at least one of the control units, an abnormality treatment such that the apply of the electric power to the heater is stopped or the like is executed.

Due to this, a plurality of control units execute a control such as apply of the electric power to the heater or the like which results in an increase in temperature or moisture of the apparatus while checking the rotation of the fan motor. Due to this, even in the case where one of the control units does not normally operate by the runaway of the CPU or the like, the abnormality of the fan motor is detected by another control unit and the control which results in an increase in temperature or moisture of the apparatus is stopped, thereby further assuring a safety of the apparatus.

Although the above two embodiments have been described with respect to the LBPFAX, for example, the invention can be also applied to a recording apparatus having a fixing device such as electrostatic type printer or copying apparatus or the like. For instance, when the second embodiment is applied to a printer or copying apparatus, the first control unit is constructed so as to include the CPU having a PDL interpreter in a printer or so as to include the CPU for controlling the original reading unit in a copying apparatus, while the second control unit is constructed so as to control the recording operation. The processes shown in FIG. 4 are executed in the first and second control units.

The present invention is not limited to the foregoing embodiments but many modifications and variations are possible within the spirit and scope of the appended claims of the invention.

What is claimed is:

1. A recording apparatus comprising:

means for generating dot data;

recording means for performing a recording operation with the generated dot data;

a first control unit for performing a control regarding the generation of dot data;

a second control unit for controlling the recording operation;

a fan for reducing a temperature in the apparatus;

a heat fixing device having a heater; and temperature detecting means for detecting a temperature of a portion around said heat fixing device, wherein each of said first control unit and said second control unit independently generates a fan control signal to control said fan in accordance with an output from said temperature detecting means.

2. An apparatus according to claim 1, wherein said temperature detecting means includes a thermistor.

3. An apparatus according to claim 1, wherein said heat fixing device has a film, one surface of which is in contact with said heater and a pressure roller which is in contact with another surface of said film, and a recording paper is sandwiched between said endless film and said pressure roller and is allowed to pass therebetween.

4. An apparatus according to claim 1, wherein said recording means is an electrostatic recording means.

5. An apparatus according to claim 1, wherein said apparatus is a facsimile apparatus and said first control unit controls a communication and an original reading operation.

6. An apparatus according to claim 1, wherein each of said first control unit and said second control unit independently generates a heater control signal to control application of an electric power to said heater.

7. An apparatus according to claim 1, further having means for generating a detection signal indicating that said fan is normally rotating.

8. An apparatus according to claim 7, wherein each of said first control unit and said second control unit independently generates the fan control signal to control the fan and the heater control signal to control applying of the electric power to the heater in accordance with an output of said detection signal and an output from said second detecting means.

9. An apparatus according to claim 1, wherein each of said first and second control units has A/D converting means for converting the output of said temperature detecting means into a digital value and CPU to which said digital value is given.

10. An apparatus according to claim 1, further having a plurality of detecting means.

11. A recording apparatus comprising:

recording means for performing a recording operation;

a heat fixing device having a heater;

a fan to reduce a temperature in said apparatus;

a plurality of temperature detecting means for detecting temperatures at a plurality of positions near said heat fixing device, respectively, and for generating outputs;

an A/D converter for converting outputs from said plurality of temperature detecting means into digital values; and a CPU, wherein said CPU executes calculations in accordance with the digital values respectively corresponding to the temperatures at said plurality of positions and generates a fan control signal to rotate said fan.

12. An apparatus according to claim 11, wherein said plurality of temperature detecting means includes a thermistor.

13. An apparatus according to claim 11, wherein said heat fixing device has a film, one surface of which is in contact with said heater and a pressure roller which is in contact with another surface of said film, and recording paper is sandwiched between said film and said pressure roller and is allowed to pass therebetween.

14. An apparatus according to claim 11, wherein said recording means is an electrostatic recording means.

15. An apparatus according to claim 11, wherein said apparatus is a facsimile apparatus.

16. An apparatus according to claim 11, wherein said CPU calculates a temperature at a specific position in accordance with the digital values respectively corresponding to the temperatures of said plurality of positions.

17. An apparatus according to claim 11, further having means for generating a detection signal indicating that said fan is normally rotating, wherein said CPU generates the fan control signal and a heater control signal to control application of electric power to said heater in accordance with said digital values and said detection signal.

18. An apparatus according to claim 13, wherein said CPU calculates a temperature of a contact portion between said film and one of said pressure roller and said heater.

19. An apparatus according to claim 13, wherein at least one of said plurality of said temperature detecting means is contactable with one of said heater and said pressure roller.

20. An apparatus according to claim 18, further comprising means for conveying recording paper to said heat fixing device, wherein said CPU calculates temperatures at a position at which the recording paper passes and/or a position at which the recording paper does not pass.

* * * * *

UNITED STATES PATENT AND TRADEMARK OFFICE

CERTIFICATE OF CORRECTION

PATENT NO. : 5,530,556
DATED : June 25, 1996
INVENTOR(S) : SHIGEO MIURA, ET AL.

It is certified that error appears in the above-indentified patent and that said Letters Patent is hereby corrected as shown below:

Column [57] ABSTRACT,
line 11, "by" should read --of--;
line 12, "is come" should read --comes--; and
line 13, "is come" should read --comes--.
Column 5,
line 15, "invention;" should read --invention; and--; and
line 19, "embodiment; and" should read --embodiment.--.
Column 6,
line 46, "onverter" should read --converter--.
Column 8,
line 53, "be" should be deleted.
Column 9,
line 45, "are" should read --is--; and
line 59, "are" should read --is--.
Column 11,
line 51, "apply" should read --application--.
Column 12,
line 56, "and" should read --and a--.

Signed and Sealed this

Seventeenth Day of December, 1996

*Attest:*

*Attesting Officer*

Bruce Lehman

BRUCE LEHMAN

*Commissioner of Patents and Trademarks*